US007995946B2

(12) United States Patent
Ueda et al.

(10) Patent No.: US 7,995,946 B2
(45) Date of Patent: Aug. 9, 2011

(54) IMAGE FORMING APPARATUS HAVING CLEANING MEMBER FOR CLEANING TRANSMISSION MEMBER

(75) Inventors: Shinichi Ueda, Mishima (JP); Kazushi Ino, Suntou-gun (JP); Tamotsu Kaneko, Suntou-gun (JP); Satoshi Murasaki, Suntou-gun (JP); Ken-ichi Tomita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 12/038,655

(22) Filed: Feb. 27, 2008

(65) Prior Publication Data

US 2008/0205951 A1 Aug. 28, 2008

(30) Foreign Application Priority Data

Feb. 28, 2007 (JP) ..... 2007-049132
Jan. 25, 2008 (JP) ..... 2008-014551

(51) Int. Cl.
*G03G 21/00* (2006.01)

(52) U.S. Cl. ..... 399/98

(58) Field of Classification Search ..... 399/98, 399/99

See application file for complete search history.

(56) References Cited

U.S. PATENT DOCUMENTS

| | | | | |
|---|---|---|---|---|
| 7,436,426 | B2 | 10/2008 | Lim | |
| 7,515,171 | B2 * | 4/2009 | Lim | 347/263 |
| 2005/0243156 | A1 | 11/2005 | Matsutomo | |
| 2007/0098423 | A1 * | 5/2007 | Hirayama et al. | 399/49 |

FOREIGN PATENT DOCUMENTS

| | | | |
|---|---|---|---|
| JP | 63055574 | A * | 3/1988 |
| JP | 63-75764 | | 4/1988 |
| JP | 02064682 | A * | 3/1990 |
| JP | 02240666 | A * | 9/1990 |
| JP | 04-159574 | | 6/1992 |
| JP | 04-323669 | | 11/1992 |
| JP | 09-244362 | | 9/1997 |
| JP | 2001-343876 | | 12/2001 |
| JP | 2002267983 | A * | 9/2002 |
| JP | 2004-226536 | | 8/2004 |
| JP | 2004-333799 | | 11/2004 |
| JP | 2005041147 | A * | 2/2005 |
| JP | 2005-246901 | | 9/2005 |
| JP | 2005-313459 | | 11/2005 |
| JP | 2006-039016 | | 2/2006 |
| JP | 2008008989 | A * | 1/2008 |

OTHER PUBLICATIONS

Computer translation of JP2005-041147A; Feb. 2005.*

* cited by examiner

*Primary Examiner* — Quana M Grainger
(74) *Attorney, Agent, or Firm* — Canon USA Inc IP Division

(57) ABSTRACT

An image forming apparatus includes a photosensitive drum, an optical unit provided below the photosensitive drum and including a cover glass for transmitting light emitted toward the photosensitive drum, and a cleaning member configured to clean a surface of the cover glass. The cleaning member includes a cleaning sheet configured to move foreign substances on the surface, and a wiping member configured to wipe foreign substances from the surface. The cleaning sheet and the wiping member move in contact with the surface of the cover glass when the cleaning member cleans the surface. The wiping member moves in contact with a portion of the surface of the cover glass after the cleaning sheet moves in contact with the portion. Accordingly, the cover glass can be reliably cleaned even when an unexpectedly large number of foreign substances that vary in particle size and shape adhere to the cover glass.

16 Claims, 12 Drawing Sheets

HOME POSITION

DURING CLEANING

END OF CLEANING

RETURN TO HOME POSITION

HOME POSITION

DURING CLEANING

IMAGE FORMING APPARATUS HAVING CLEANING MEMBER FOR CLEANING TRANSMISSION MEMBER

BACKGROUND OF THE INVENTION

1. Field of the Invention

The present invention relates to an image forming apparatus such as a copying machine, a printer, or a facsimile machine.

2. Description of the Related Art

In recent electrophotographic image forming apparatuses, toner used as developing agent scatters, and dust sometimes floats, depending on the use environment. Since an optical unit provided in the image forming apparatuses is sensitive to toner and dust, the interior of the optical unit is hermetically sealed so as to prevent the entry of toner and dust. Further, an aperture is provided so that laser light emitted from the optical unit passes therethrough. In order to prevent toner and dust from entering the optical unit, a cover glass that transmits the laser light is provided at the aperture.

In this configuration, a decrease in printing density and an image deficit are sometimes caused when toner and dust dropping from the developing section and floating in the image forming apparatus enter the optical path of exposure light, adhere to the cover glass, and block the optical path. In order to avoid the decrease in density and the image deficit described above, it is necessary to devise a structure that prevents toner and dust from adhering to the cover glass.

Hitherto, a user or serviceman has accessed the interior of the image forming apparatus and has cleaned the cover glass with a soft cloth or the like. However, since the area of the aperture having the cover glass is small and cleaning needs to be performed without scratching the surface of the cover glass, the cleaning operation is considerably troublesome, and sufficient cleaning is difficult.

In order to overcome these problems, various cleaning structures for removing toner and dust from the cover glass have been proposed. For example, Japanese Patent Laid-Open No. 4-159574 discloses a cleaning device that allows the user or serviceman to remove toner and dust from a cover glass simply by sliding a cleaning member formed of synthetic resin foam via a support means provided in an optical unit.

Japanese Patent Laid-Open No. 2005-313459 (corresponding to US Patent Publ. No. 2005/243156) discloses a cleaning structure in which a shutter member for closing and opening the optical path of a light beam is provided with a seal member, and the seal member includes a cleaning member that slides on the cover glass.

Japanese Patent Laid-Open No. 63-75764 discloses a cleaning mechanism in which a shutter includes a plurality of cleaners each formed by an elastic blade, a brush, or a fleece cloth, and the cleaners slide on a light emitting window of an optical device.

Japanese Patent Laid-Open No. 2004-333799 discloses that a scanner cover includes a plurality of cleaners each formed by a brush or an elastic member and the cleaners clean a dustproof glass of a laser scanner while being in contact with the dustproof glass.

In recent years, the environment in which the image forming apparatus is installed has been diversified, and various substances adhere to the cover glass. Specifically, the substances include not only toner, but also dust in the air and wear powder produced in the body of the image forming apparatus. Since the substances vary in particle size and shapes, even when cleaning is performed by moving toner and dust with an elastic blade or a brush serving as a cleaning member, it is difficult to completely remove toner and dust having a minute particle size and shape. This may result in an image defect.

The amount of toner and dust adhering to the cover glass tends to increase as the life of the image forming apparatus increases. For this reason, there is an increasing fear that a lot of toner and dust adhering to the cover glass will not be completely wiped away by cloth or sponge serving as a cleaning member and that this may cause an image defect. That is, since the cleaning performance of the wiping cleaning member easily saturates, it is necessary to replace the cleaning member many times in the life of the apparatus. Moreover, the wiped toner and dust may adhere from the cleaning member onto the cover glass again.

In addition, with size reduction and increases in output speed of the image forming apparatus, the amount of heat generated in the image forming apparatus has increased, and the necessity of cooling the interior of the image forming apparatus has been raised in order to ensure a high image print quality. Practically, external air is taken into the image forming apparatus and is blown on a heat generating portion, thus cooling the interior of the image forming apparatus. For this reason, the amount of dust entering the image forming apparatus increases, and toner scatters in a wider area in the image forming apparatus. Consequently, the possibility that toner and dust will adhere to the cover glass increases.

SUMMARY OF THE INVENTION

The present invention is directed to an image forming apparatus in which a cover glass can be reliably cleaned even when an unexpectedly large number of foreign substances (toner and dust) that vary in particle size and shape adhere to the cover glass.

An image forming apparatus according to an aspect of the present invention includes an image bearing member configured to bear a toner image; an optical unit provided below the image bearing member and including a transmission member configured to transmit light emitted toward the image bearing member; and a cleaning member configured to clean a surface of the transmission member, the cleaning member including a sheet configured to move a foreign substance on the surface of the transmission member, and a wiping portion configured to wipe away a foreign substance on the surface of the transmission member. The sheet and the wiping portion move in contact with the surface of the transmission member when the cleaning member cleans the surface of the transmission member. The wiping portion moves in contact with a portion of the surface of the transmission member after the sheet moves in contact with the portion.

An image forming apparatus according to another aspect of the present invention includes an image bearing member configured to bear a toner image; an optical unit provided below the image bearing member and including a transmission member configured to transmit light emitted toward the image bearing member; and a cleaning member including a first cleaning portion and a second cleaning portion configured to clean a surface of the transmission member. The first cleaning portion and the second cleaning portion are in contact with the surface of the transmission member when the cleaning member cleans the surface of the transmission member while moving from a cleaning start position to a cleaning end position. The first cleaning portion and the second cleaning portion are out of contact with the surface of the transmission member when the cleaning member returns to the cleaning start position.

An image forming apparatus according to a further aspect of the present invention includes a rotatable image bearing member configured to bear a toner image; a process cartridge including the image bearing member and a process unit configured to act on the image bearing member, the process cartridge capable of being inserted into and drawn out of a body of the image forming apparatus in a rotation axis direction of the image bearing member; an optical unit provided below the image bearing member and including a transmission member configured to transmit light emitted toward the image bearing member; and a cleaning member configured to clean a surface of the transmission member. The cleaning member moves in association with insertion of the process cartridge in the body of the image forming apparatus in the rotation axis direction of the image bearing member.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings. The dimensions, materials, shapes, relative arrangement, and so on of constituent parts described in the exemplary embodiments should be appropriately altered in accordance with the apparatus to which the present invention is applied and various conditions, and are not intended to restrict the scope of this invention to the embodiments.

First Exemplary Embodiment

An image forming apparatus according to a first exemplary embodiment of the present invention will be described with reference to FIGS. 1 to 6. The dimensions, materials, shapes, relative arrangement, and so on of constituent parts described in the first exemplary embodiment are not intended to restrict the scope of this invention thereto unless particularly specified.

Overall Configuration of Image Forming Apparatus

Figure 1:
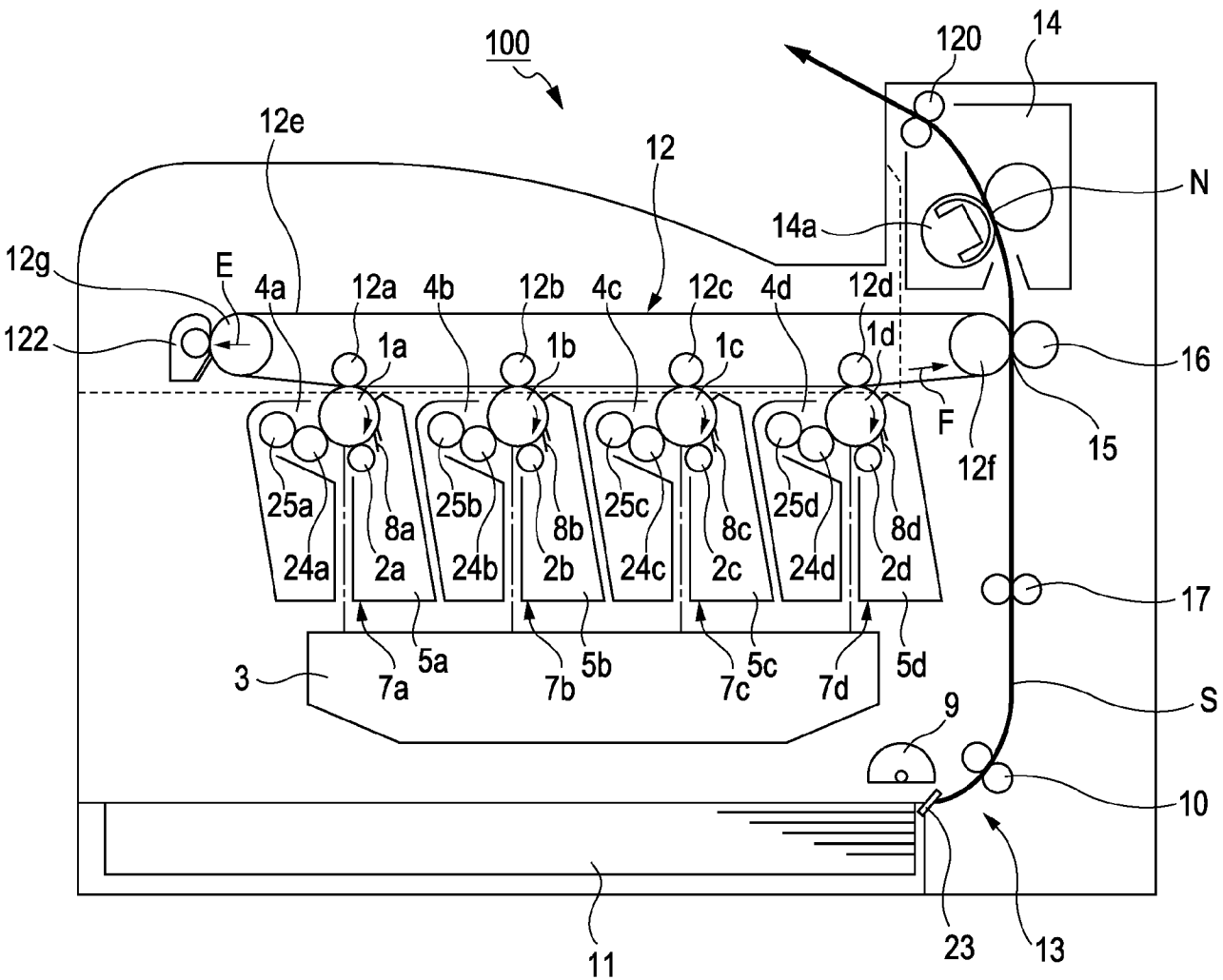
FIG. 1 is a cross-sectional view of a multicolor image forming apparatus according to a first exemplary embodiment of the present invention.

The overall configuration of the image forming apparatus will be described generally. FIG. 1 is a longitudinal sectional view showing the overall configuration of a color laser printer 100 as an example of an image forming apparatus.

The color laser printer 100 shown in FIG. 1 includes four rotatable photosensitive drums 1 (1*a*, 1*b*, 1*c*, and 1*d*), an optical unit 3, a feeding device 13, a fixing unit 14, and a secondary charging unit 15.

Around each of the photosensitive drums 1, a charging roller 2 (2*a*, 2*b*, 2*c*, 2*d*), a developing unit 4 (4*a*, 4*b*, 4*c*, 4*d*), a cleaner unit 5 (5*a*, 5*b*, 5*c*, 5*d*), an intermediate transfer belt unit 12, and a drum cleaning blade 8 (8*a*, 8*b*, 8*c*, 8*d*) are arranged in that order in the rotating direction of the photosensitive drum 1. These components provided around the photosensitive drum 1 are referred to as a process unit that acts on the photosensitive drum 1, as described more fully below.

The photosensitive drum 1, the charging roller 2, the developing unit 4, the cleaner unit 5, and the cleaning blade 8 are combined into a process cartridge 7 (7*a*, 7*b*, 7*c*, 7*d*). The process cartridge 7 can be inserted into and drawn from the color laser printer 100 in the rotation axis direction of the photosensitive drum 1.

While four process cartridges 7*a*, 7*b*, 7*c*, and 7*d* have the same structure, they form images with toners of different colors, namely, yellow (Y), magenta (M), cyan (C), and black (Bk).

The developing units 4*a*, 4*b*, 4*c*, and 4*d* respectively include developing rollers 24*a*, 24*b*, 24*c*, and 24*d*, developing-agent supply rollers 25*a*, 25*b*, 25*c*, and 25*d*, and toner containers.

the cleaner units 5*a*, 5*b*, 5*c*, and 5*d* respectively include the photosensitive drums 1*a*, 1*b*, 1*c*, and 1*d* serving as image bearing members, charging rollers 2*a*, 2*b*, 2*c*, and 2*d*, cleaning blades 8*a*, 8*b*, 8*c*, and 8*d*, and waste-toner containers.

Each of the photosensitive drums 1*a* to 1*d* is formed by coating an outer peripheral surface of an aluminum cylinder with an organic photoconductor (OPC) layer. The photosensitive drum 1 is rotatably supported at both ends by flanges, and is rotated in the direction of arrow (clockwise) in FIG. 1 by transmitting a driving force from a driving motor (not shown) to one end thereof.

The charging rollers 2*a* to 2*d* are conductive. By bringing the charging rollers 2*a* to 2*d* into contact with the surfaces of the photosensitive drums 1*a* to 1*d* and applying a charging bias voltage from a power supply (not shown), the surfaces of the photosensitive drums 1*a* to 1*d* are charged uniformly.

The optical unit 3 is disposed below the process cartridges 7*a* to 7*d*, and exposes the photosensitive drums 1*a* to 1*d* according to image signals, thus forming electrostatic latent images on the photosensitive drums 1*a* to 1*d*.

With the above-described configuration, the photosensitive drums 1*a* to 1*d* are charged with a predetermined negative potential by the charging rollers 2*a* to 2*d*, and electrostatic latent images are then formed thereon by the optical unit 3. The electrostatic latent images are reversely developed with toner having a negative polarity by the developing units 4*a* to 4*d* so as to form Y, M, C, and Bk toner images.

In the intermediate transfer belt unit 12, an intermediate transfer belt 12*e* is tightly stretched from a driving roller 12*f* to a tension roller 12*g*, and the tension roller 12*g* gives a tension in the direction of arrow E. Primary transfer rollers 12*a*, 12*b*, 12*c*, and 12*d* are provided inside the intermediate transfer belt 12*e* so as to respectively oppose the photosensitive drums 1*a*, 1*b*, 1*c*, and 1*d*. A transfer bias is applied to the primary transfer rollers 12*a* to 12*d* by a bias supply means (not shown).

When the photosensitive drums 1*a*, 1*b*, 1*c*, and 1*d* are rotated in the direction of arrows, the intermediate transfer belt 12*e* is rotated in the direction of arrow F, and a positive bias is applied to the primary transfer rollers 12*a*, 12*b*, 12*c*, and 12*d*. Thus, the toner images on the photosensitive drums 1*a* to 1*d* are primarily transferred in order from the toner image on the photosensitive drum 1*a* onto the intermediate transfer belt 12*e*, so that the four color toner images are conveyed to the secondary transfer section 15 while being superimposed.

The feeding device 13 includes a feeding roller 9 that feeds sheets S from a feeder cassette 11 that stores the sheets S, and a pair of conveying rollers 10 that convey the fed sheets S.

The feeder cassette 11 can be drawn out toward the front side of FIG. 1 (in the rotation axis direction of the photosensitive drum 1). The user draws and takes the feeder cassette 11 out of the apparatus body, sets sheets S in the feeder cassette 11, and inserts the feeder cassette 11 into the apparatus body, so that sheet supply is completed.

The sheets S stored in the feeder cassette 11 are separated and conveyed one by one by a separation pad 23 while being in pressing contact with the feeding roller 9 (this separation method is referred to as a frictional separation method).

One sheet S is conveyed from the feeding device 13 to the secondary transfer section 15 by a pair of registration rollers 17.

By applying a positive bias to a secondary transfer roller 16 in the secondary transfer section 15, the four color toner images on the intermediate transfer belt 12*e* are secondarily transferred onto the conveyed sheet S.

The fixing unit 14 fixes the images formed on the sheet S by heat and pressure.

While the sheet S is conveyed through a fixing nip N together with a fixing belt 14*a*, the sheet is heated by a heater provided in the fixing belt 14*a*, and the unfixed toner images on the sheet S are fixed by heat. The fixed sheet S is output into an output tray (not shown) by a pair of output rollers 120.

After the toner images are transferred, toner remaining on the photosensitive drums 1*a*, 1*b*, 1*c*, and 1*d* is removed by the cleaning blades 8*a*, 8*b*, 8*c*, and 8*d*. The removed toner is collected into the waste-toner containers provided in the cleaner units 5*a*, 5*b*, 5*c*, and 5*d*.

Further, toner remaining on the intermediate transfer belt 12*e* after secondary transfer onto the sheet S is removed by a transfer-belt cleaner 122, passes through a waste-toner conveying path (not shown), and is collected into a waste-toner collecting container (not shown) provided in the inner portion of the color laser printer 100.

Structure of Cleaning Member 20

Figure 2:
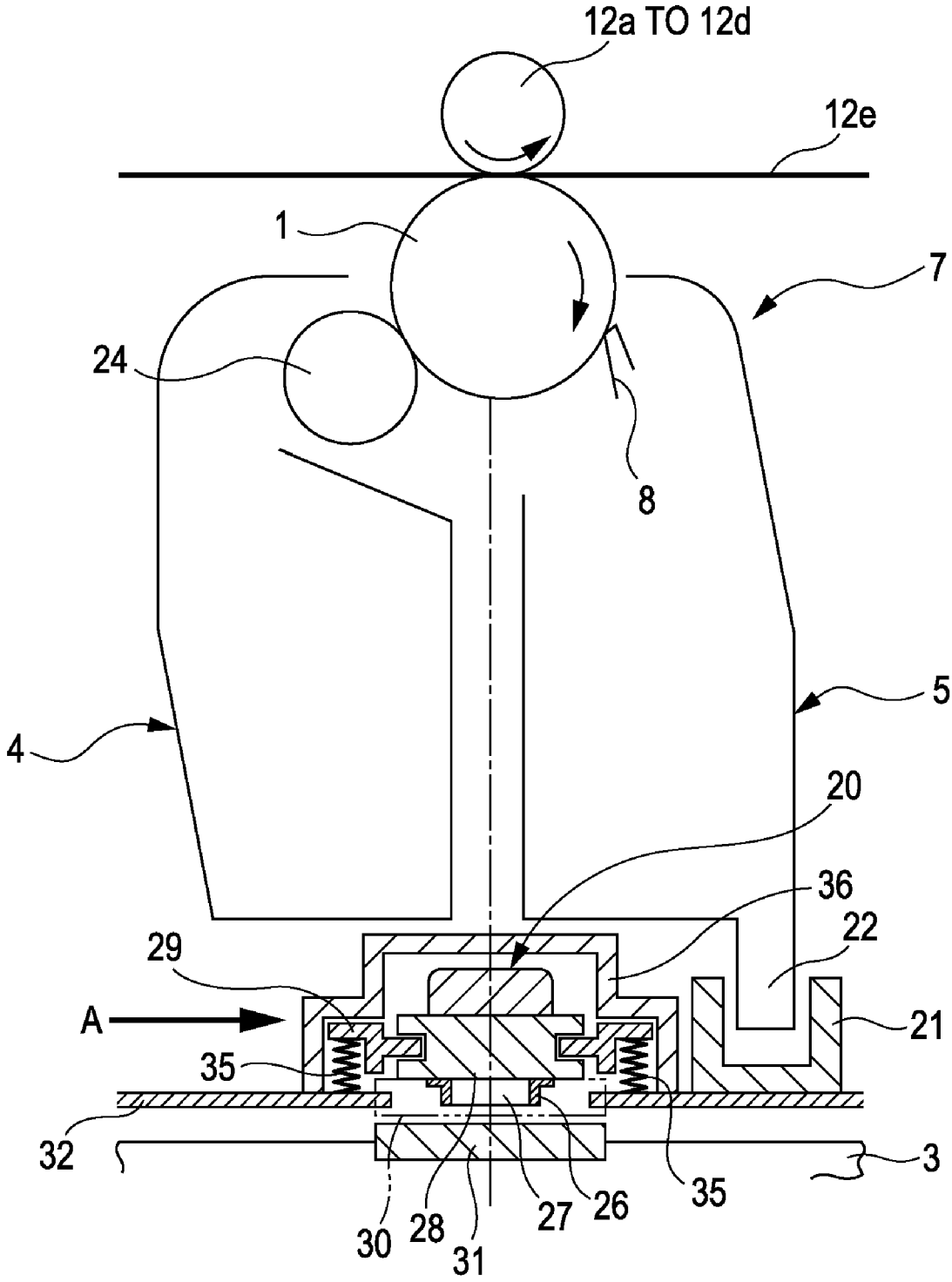
FIG. 2 is a cross-sectional view showing an optical unit, a process cartridge, and a cleaning member in the first exemplary embodiment.
Figure 3A:
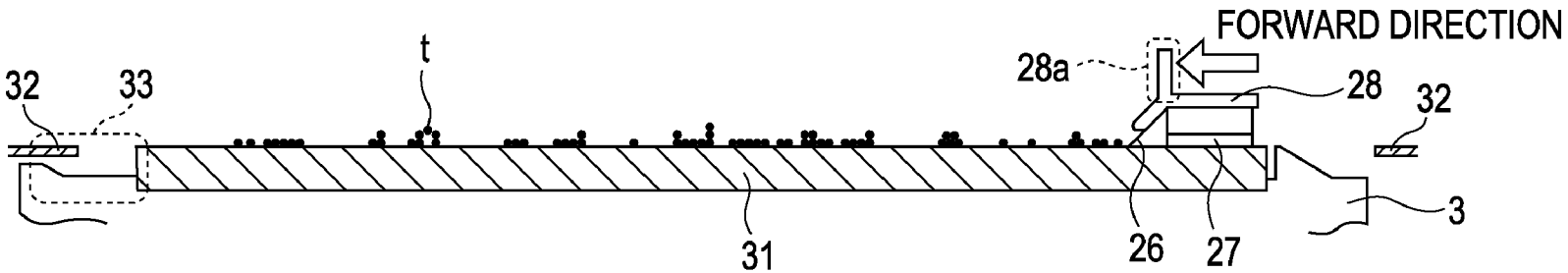
FIGS. 3A and 3B are cross-sectional views showing a cleaning state of the cleaning member.
Figure 3B:
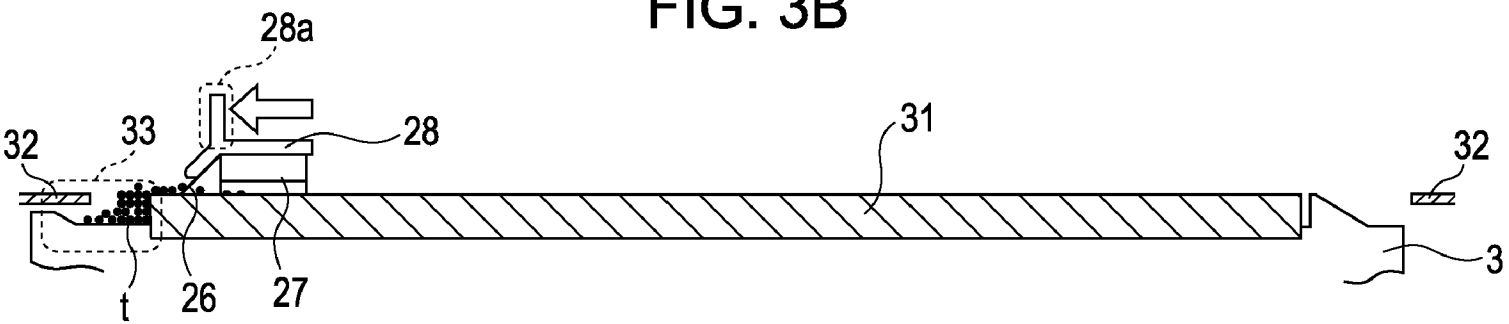

FIG. 2 shows one process cartridge 7, the optical unit 3, and a cleaning member 20, as viewed from the principal section of the color laser printer 100. FIGS. 3A and 3B show the cleaning member 20, as viewed in the A-direction in FIG. 2.

As shown in FIG. 2, the color laser printer 100 includes a stay member 32 that forms a frame of the body of the printer. The stay member 32 includes an aperture 30 that defines an optical path for light emitted from the optical unit 3, and a cartridge insertion guide 21 provided near the aperture 30. The user can easily load the process cartridge 7 to a predetermined position in the apparatus body by inserting an insertion rib 22 provided integrally with the process cartridge 7 along the cartridge insertion guide 21 in the rotation axis direction of the photosensitive drum 1. When the process cartridge 7 is positioned in the apparatus body, a boss (not shown) provided on the process cartridge 7 is fitted in a hole (not shown) provided in the apparatus body. In this state, the insertion rib 22 and the cartridge insertion guide 21 are not in contact with each other.

The aperture 30 is covered with a cover glass 31 serving as a transmission member through which light emitted from the optical unit 3 passes. In order to avoid an image defect, the cover glass 31 prevents foreign substances, such as dust and toner, from entering the optical unit 3 through the aperture 30 and soiling functional components in the optical unit 3.

The color laser printer 100 includes the cleaning member 20 that cleans the cover glass 31 by sliding on a surface (cleaning surface) of the cover glass 31.

The cleaning member 20 includes a cleaning sheet 26, a wiping member 27, and a base member 28 on which the cleaning sheet 26 and the wiping member 27 are mounted. The base member 28 of the cleaning member 20 is moved in the rotation axis direction of the photosensitive drum 1 along a base guide 29 supported by the stay member 32.

The cleaning sheet 26 is flexible. During cleaning, a leading edge of the cleaning sheet 26 moves in contact with the surface of the cover glass 31 so as to move foreign substances on the surface.

The wiping member 27 moves in contact with the surface of the cover glass 31 during cleaning, and wipes away foreign substances remaining on the surface of the cover glass 31 after movement of the cleaning sheet 26.

As shown in FIGS. 3A and 3B, the contact angle between the cleaning sheet 26 and the surface of the cover glass 31 (angle on the downstream side in the forward direction of the cleaning member 20 during cleaning) is obtuse, and is set at about 135° in the first exemplary embodiment. This angle allows the cleaning sheet 26 to sufficiently move even a lot of toner and dust, and can minimize passage of the toner and dust between the cleaning sheet 26 and the surface of the cover glass 31. When the angle between the cleaning sheet 26 and the surface of the cover glass 31 is too large, the cleaning sheet 26 does not touch at the leading edge with the surface of the cover glass 31, but touches on its belly. Consequently, passage of foreign substances occurs frequently. Conversely, when the angle between the cleaning sheet 26 and the surface of the cover glass 31 is too small, the cleaning sheet 26 turns up. In the first exemplary embodiment, the angle is set at 135° in view of these phenomena. This prevents both passage of the foreign substances between the cleaning sheet 26 and the surface of the cover glass 31 and turn-up of the cleaning sheet 26.

The leading edge of the cleaning sheet 26 is in contact in a bent form with the surface of the cover glass 31, and the wiping member 27 is in contact with the surface of the cover glass 31 while being pressed down toward the surface. In the first exemplary embodiment, the wiping member 27 is formed by bonding a urethane foam material having a thickness of about 2 mm and a hardness of about 100 N and a polyester nonwoven cloth having a thickness of about 1.5 mm by welding. During use, the cleaning sheet 26 is bent by 1 mm, and the wiping member 27 is pressed down by 1 mm.

Figure 4:
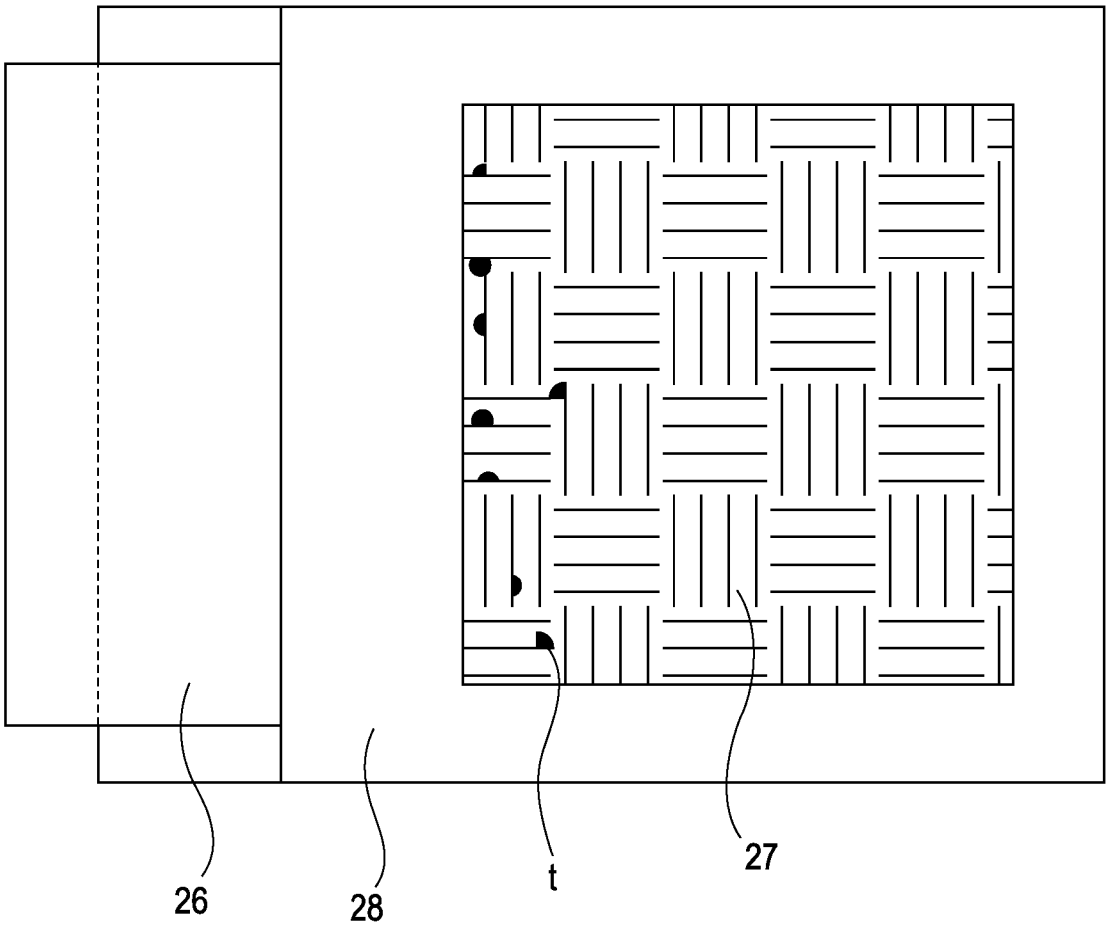
FIG. 4 is a schematic view showing a state after a wiping portion wipes foreign substances in the first exemplary embodiment.

FIG. 4 is a schematic view showing a state of the wiping member 27 after cleaning of the surface of the cover glass 31. As shown in FIG. 4, the wiping member 27 is formed by an unwoven cloth (fibrous material). Therefore, foreign substances t, such as dust and toner particles, are entangled and collected in the fiber of the wiping member 27. The collected foreign substances t do not easily separate from the wiping member 27.

By moving the cleaning member 20 in the direction of arrow in FIG. 3 (forward direction) during cleaning, the leading edge of the cleaning sheet 26 moves relatively large foreign substances of the toner and dust on the surface of the cover glass 31. Subsequently, the wiping member 27 wipes relatively small foreign substances that could not be removed by the cleaning sheet 26.

The cover glass 31 is a longitudinal member, and the cleaning member 20 moves in the longitudinal direction of the cover glass 31. In this case, the longitudinal direction of the cover glass 31 coincides with the rotation axis direction of the photosensitive drum 1 so that light is reliably applied onto the photosensitive drum 1 through the cover glass 31. In this configuration, the contact area between the cleaning member 20 and the surface of the cover glass 31 is smaller than when the cleaning member 20 moves in the lateral direction of the cover glass 31. Therefore, a uniform contact state can be easily maintained between the cleaning member 20 and the cover glass 31, and lifting of the cleaning member 20 can be prevented.

Foreign substances t moved out of the surface of the cover glass 31 by the cleaning sheet 26 are collected in a storage portion 33 provided at one end of the cover glass 31 in the longitudinal direction (downstream of the cover glass 31 in the forward direction of the cleaning sheet 26 during cleaning). The storage portion 33 is concave, and is disposed outside the optical path area and downstream of the cover glass 31 in the forward direction of the cleaning member 20 during cleaning. This structure allows the foreign substances t moved by the cleaning member 20 to be collected in one place without scattering in the apparatus. Further, since the storage portion 33 is concave, the foreign substances t stored therein can be prevented from entering the optical path area again because of vibration caused by the body of the image forming apparatus and an external impact.

By thus forming the cleaning member 20 by a combination of cleaning portions (cleaning sheet 26 and wiping member 27) having different cleaning concepts, the following merits are brought about.

First, not only toner, but also dust entering the image forming apparatus from the outside and wear powder produced in the apparatus body can adhere onto the surface of the cover glass 31. For this reason, it is necessary to clean the surface of the cover glass 31 of foreign substances that vary in particle size and shape. By combining the cleaning sheet 26 and the wiping member 27 having different cleaning concepts, foreign substances that vary in particle size and shape can be reliably removed from the surface of the cover glass 31.

Secondly, when the cleaning member 20 includes only the wiping member 27, cleaning durability is determined by the number of foreign substances that can be collected in the wiping member 27. For this reason, if the number of foreign substances collected in the wiping member 27 reaches a level of saturation, the wiping member 27 can collect no more foreign substances. When the wiping member 27 comes into contact with the cover glass 31 again in this state, it sometimes soils the cover glass 31 on the contrary. Accordingly, after relatively large foreign substances are moved by the cleaning sheet 26, relatively small foreign substances remaining on the surface of the cover glass 31 are wiped away by the wiping member 27. This can delay the time when the collecting amount by the wiping member 27 reaches the limit, and can noticeably increase the durability of the cleaning member 20.

Consequently, it is possible to prevent the cleaning member 20 from failing to sufficiently remove the foreign substances on the surface of the cover glass 31 and soiling the cover glass 31. Therefore, it is possible to avoid an image defect, such as a decrease in image density and an image deficit, due to the foreign substances on the surface of the cover glass 31 through the life of the apparatus.

Thirdly, when the cleaning member 20 includes only the cleaning sheet 26, it is necessary to accurately manage the dimensional tolerance of the cut surface of the cleaning sheet 26, degree of progress, burr height, and degree of waving of the bonded cleaning sheet 26 in order to achieve a satisfactory cleaning performance of the cleaning sheet 26. Accordingly, by combining the cleaning sheet 26 and the wiping member 27, the cost is prevented from being increased by accurate management. Further, the cleaning performance can be prevented from being reduced when strict accuracy is not perfectly achieved during mass production.

Cleaning Process

A cleaning process of the cleaning member 20 will now be described. FIGS. 5 and 6 are cross-sectional views showing the cleaning process of the cleaning member 20.

Figure 5A:
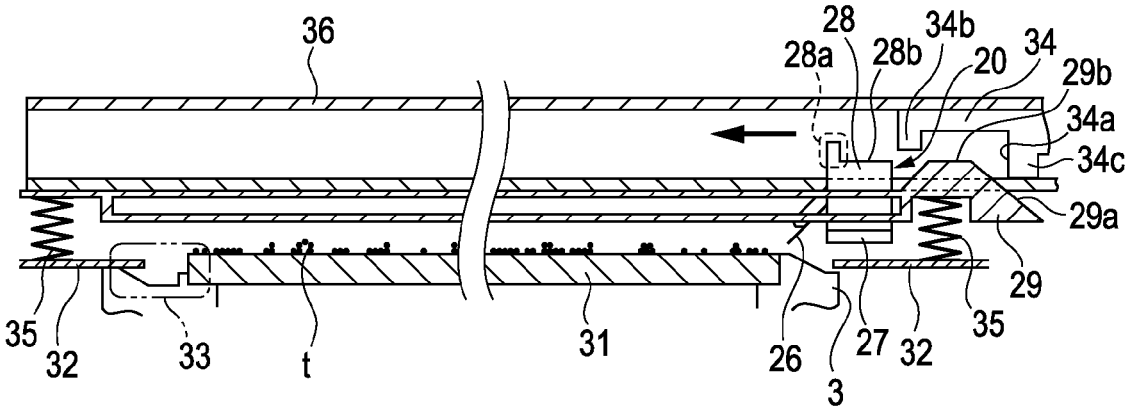
FIGS. 5A and 5B are cross-sectional views showing a cleaning process of the cleaning member in the first exemplary embodiment.

In FIG. 5A, the cleaning member 20 is placed at a home position (cleaning start position) before cleaning. On the rear side of the cleaning member 20 in the forward direction (upstream in the cleaning direction), a moving member 34 and a biasing member 35 are provided.

The moving member 34 is slidably supported by a guide rail 36 that is fixed to the body of the image forming apparatus. The biasing member 35 is disposed between the stay member 32 and the base guide 29.

The moving member 34 is stored in a door (not shown) through which replacement of the process cartridge and jam recovery are performed. When the surface of the cover glass 31 is soiled and an image defect is caused, the operator, such as a user of a serviceman, operates the moving member 34 so that the cleaning member 20 moves to clean the surface of the cover glass 31.

When the cleaning member 20 is placed at the home position, the base guide 29 is raised by the biasing member 35 to a height such that the cleaning sheet 26 and the wiping member 27 are separate from the surface of the cover glass 31.

In order for the cleaning member 20 to move from the home position for cleaning of the surface of the cover glass 31, the operator first pushes and supports the moving member 34 in the guide rail 36. Then, when the operator moves the moving member 34 in the forward direction (direction of arrow in FIGS. 5A and 5B), a biasing projection 34*c* of the moving member 34 comes into contact with an inclined face 29*a* at the leading end of the base guide 29 (near an insertion opening for the moving member 34). The base guide 29 is thereby pressed down against the biasing force of the biasing member 35.

The biasing projection 34*c* of the moving member 34 moves along the inclined face 29*a* of the base guide 29, reaches a top face 29*b* of the base guide 29, and then moves from the base guide 29 to a slide face 28*b* of the base member 28 so as to press the base member 28 down. In this state, the leading edge of the cleaning sheet 26 and the wiping member 27 are placed at a position lower by 1 mm than the surface of the cover glass 31.

Figure 5B:
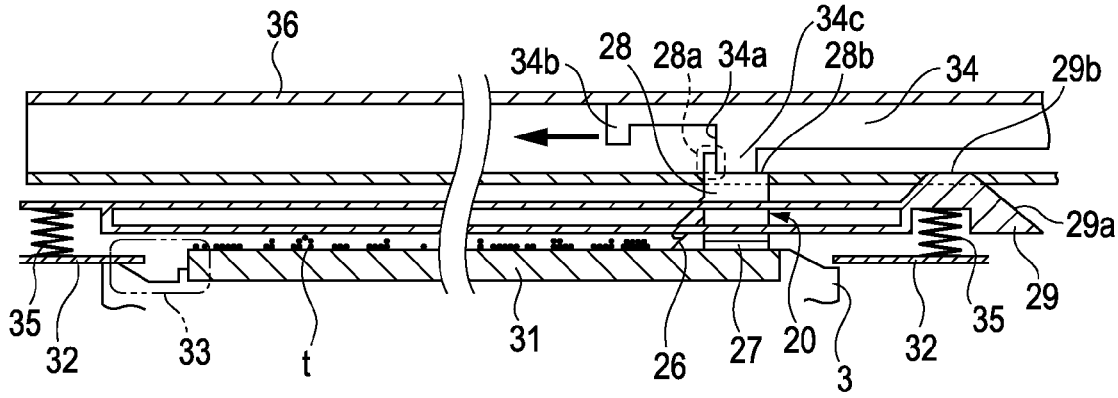

The biasing projection 34*c* of the moving member 34 moves on the slide face 28*b* in the forward direction, and an engaging portion 28*a* provided integrally with the leading end of the base member 28 engages with an engaging portion 34*a* provided at the leading end of the moving member 34. As shown in FIG. 5B, the moving member 34 moves the base member 28 in the forward direction, and the cleaning sheet 26 and the wiping member 27 move while cleaning the surface of the cover glass 31.

Figure 6A:
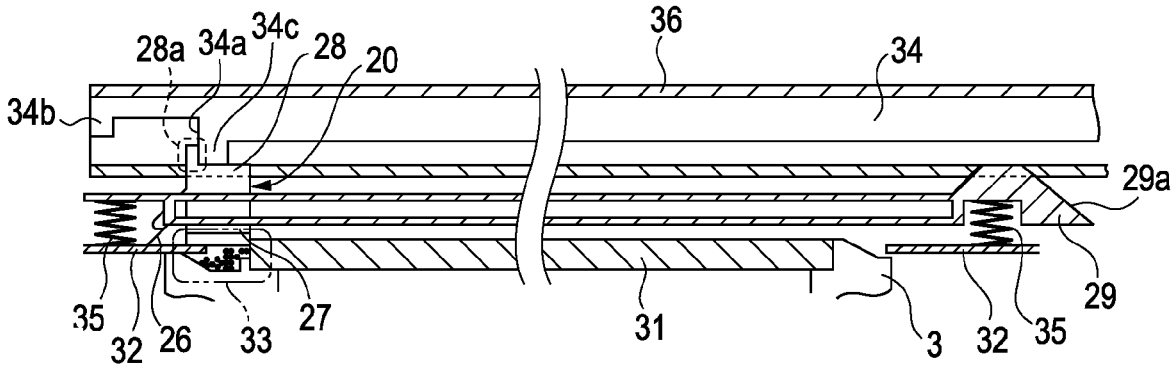
FIGS. 6A and 6B are cross-sectional views showing the cleaning process of the cleaning member.

As shown in FIG. 6A, when the cleaning sheet 26 and the wiping member 27 reach an end of the cover glass 31 (cleaning end position) and complete cleaning, foreign substances moved by the cleaning sheet 26 are dropped into the storage portion 33. A few foreign substances wiped by the wiping member 27 remain in the wiping member 27.

Figure 6B:
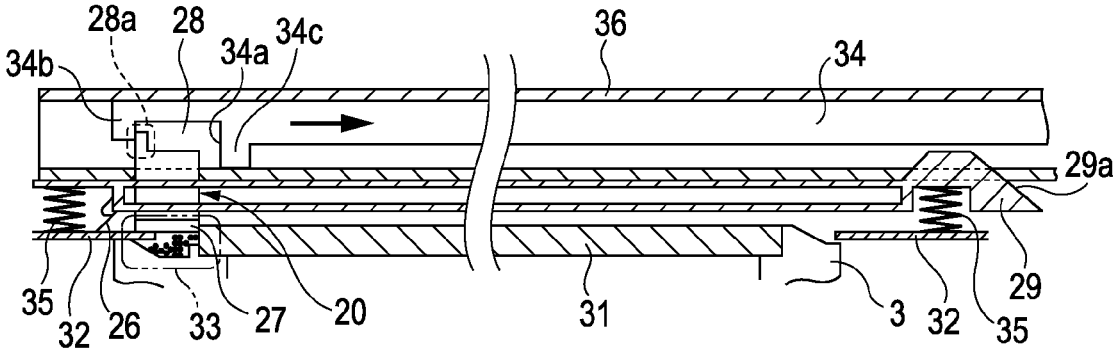

Then, as shown in FIG. 6B, the operator returns the moving member 34 in the backward direction (direction of arrow in the figure). The biasing projection 34*c* of the moving member 34 moves on the slide face 28*b* in the backward direction and then comes out of the slide face 28*b*. In this case, the cleaning sheet 26 bent by 1 mm and the wiping member 27 crushed by 1 mm by the biasing projection 34*c* of the moving member 34 are separated from the cover glass 31 by the force of the biasing member 35.

When the operator further moves the moving member 34 in the backward direction, a second engaging portion 34*b* provided at the leading end of the moving member 34 engages with the engaging portion 28*a* of the base member 28. With the backward movement of the moving member 34, the base member 28 is returned to the home position.

As described above, when the operator moves the moving member 34 in the forward direction, the cleaning sheet 26 and the wiping member 27 are brought into contact with the surface of the cover glass 31. In contrast, when the operator moves the moving member 34 in the backward direction, the cleaning sheet 26 and the wiping member 27 are separated from the surface of the cover glass 31 by the biasing force of the biasing member 35. This structure provides the following advantages.

First, it is possible to prevent the cleaning sheet 26 and the wiping member 27 from soiling the cover glass 31 again when moving in the backward direction without separating from the cover glass 31.

Since the cleaning sheet 26 is bent and the wiping member 27 is crushed relative to the cover glass 31 during cleaning, the cleaning sheet 26 and the wiping member 27 receive stress and sliding resistance. For this reason, if the cleaning sheet 26 and the wiping member 27 are also in contact with the surface of the cover glass 31 when returning to the home position, they need to have a durability corresponding to double the number of cleaning operations. By being kept away from the cover glass 31 while the base member 28 of the cleaning member 20 returns to the home position, the cleaning sheet 26 and the wiping member 27 can be formed of a material that does not require high sliding durability.

In the first exemplary embodiment, the cleaning member 20 returns to the home position while both the cleaning sheet 26 and the wiping member 27 are separate from the cover glass 31. However, the above-described advantages can be obtained as long as at least the wiping member 27 is separate from the cover glass 31 while the moving member 20 returns to the home position.

While the cleaning member 20 includes a combination of the cleaning portions having different cleaning concepts (cleaning sheet 26, wiping member 27) in the first exemplary embodiment, the above-described advantages can be obtained even when the cleaning member 20 includes a plurality of cleaning portions having the same cleaning concept.

Second Exemplary Embodiment

Figure 7A:
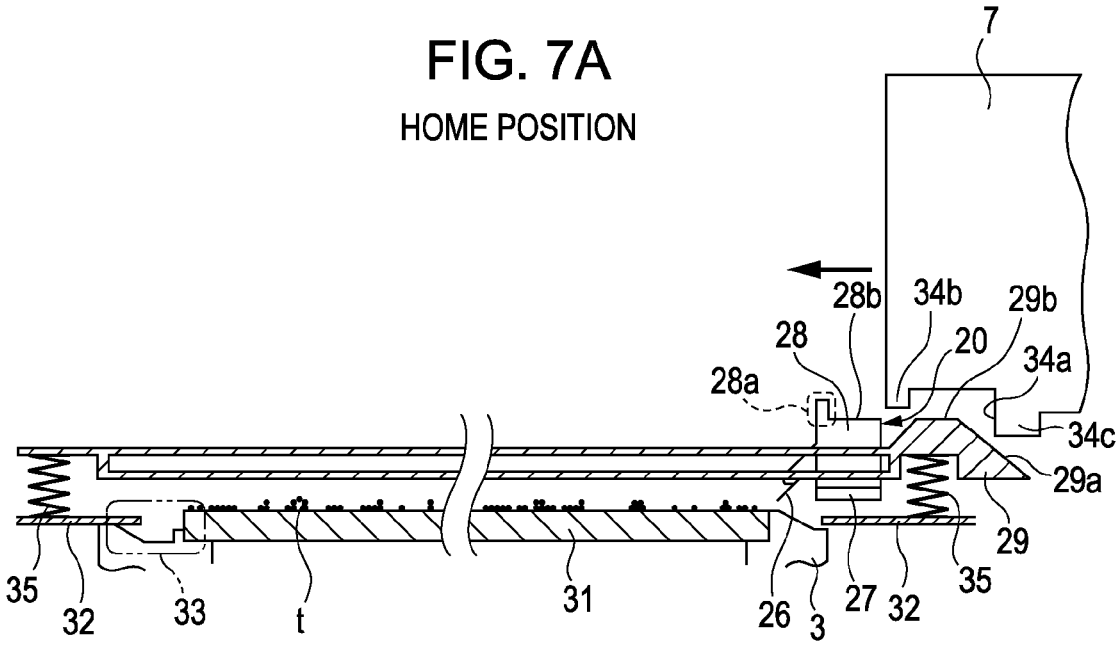
FIGS. 7A and 7B are cross-sectional views showing a cleaning process of a cleaning member according to a second exemplary embodiment of the present invention.
Figure 7B:
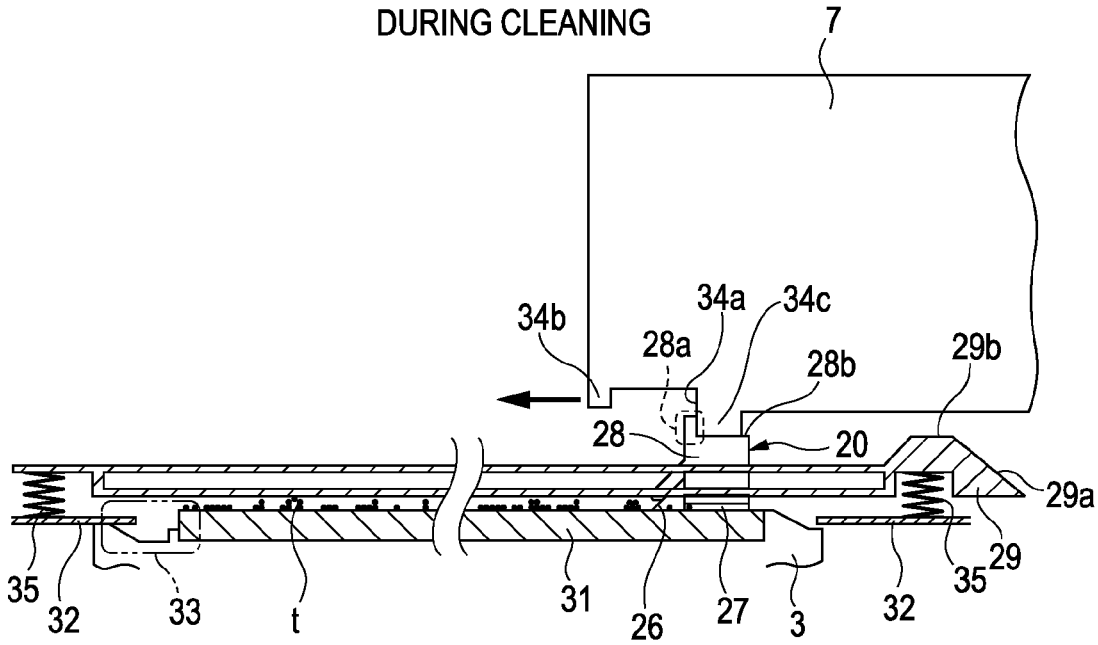

An image forming apparatus according to a second exemplary embodiment of the present invention will now be described with reference to the drawings. FIGS. 7A and 7B are cross-sectional views showing a cleaning process of a cleaning member 20 in the second exemplary embodiment. Since the basic configuration of the body of the image forming apparatus and the structure and operation of the cleaning member 20 are the same as those described in detail in the first exemplary embodiment, detailed descriptions thereof are omitted. The same components as those adopted in the first exemplary embodiments are denoted by the same reference numerals, and descriptions thereof are omitted.

In FIG. 7A, the cleaning member 20 is placed at a home position (cleaning start position) before cleaning. On the back side of the cleaning member 20 in the forward direction (upstream in the cleaning direction), a process cartridge 7 serving as a moving member and a biasing member 35 are disposed. In order to replace the process cartridge 7, the user inserts and draws the process cartridge 7 into and out of the body of the image forming apparatus.

The process cartridge 7 is slidably supported by a guide means (not shown) fixed to the body of the image forming apparatus. The biasing member 35 is provided between a stay member 32 and a base guide 29.

When the cleaning member 20 is at the home position, the base guide 29 is raised by the biasing member 35 so that a cleaning sheet 26 and a wiping member 27 are placed higher (about 1.5 mm in this exemplary embodiment) than a surface of a cover glass.

In order for the cleaning member 20 to move from the home position for cleaning of the surface of the cover glass 31, the user first supports the process cartridge 7 on the guide means (not shown) fixed to the body of the image forming apparatus. Further, when the user inserts the process cartridge 7 in the rotation axis direction of a photosensitive drum 1 (direction of arrow in FIGS. 7A and 7B), a biasing projection 34*c* provided at the bottom of the process cartridge 7 comes into contact with an inclined face 29*a* at the leading end of the base guide 29 (near an insertion hole for the process cartridge 7). The base guide 29 is thereby pressed down against the biasing force of the biasing member 35.

The biasing projection 34*c* of the process cartridge 7 moves along the inclined face 29*a* of the base guide 29, reaches a top face 29*b* of the base guide 29, and moves from the base guide 29 to a slide face 28*b* of a base member 28, thus pressing the base member 28 down. In this state, the leading edge of the cleaning sheet 26 and the wiping member 27 are placed at a position lower by 1 mm than the surface of the cover glass 31.

The biasing projection 34*c* moves on the slide face 28*b* in the forward direction, and an engaging portion 28*a* provided integrally with the leading end of the base member 28 engages with an engaging portion 34*a* provided at the leading side of the biasing projection 34*c* of the process cartridge 7. As the user inserts the process cartridge 7 into the body of the image forming apparatus, as shown in FIG. 7B, the base member 28 moves in the forward direction and the cleaning sheet 26 and the wiping member 27 move while cleaning the surface of the cover glass 31. Before the process cartridge 7 is inserted to an image forming position, the cleaning sheet 26 and the wiping member 27 reach an end of the cover glass 31 (cleaning end position) and cleaning is completed.

As the user draws the process cartridge 7 out of the body of the image forming apparatus, the base member 28 moves in the backward direction. In this case, the cleaning sheet 26 and the wiping member 27 move while not contacting with the surface of the cover glass 31. When the moving member 34 in the first exemplary embodiment is liken to the process cartridge 7, the operation of the cleaning member 20 is similar to that adopted in the first exemplary embodiment. Therefore, a detailed description of the operation is omitted.

In the second exemplary embodiment, the cleaning member 20 moves to clean the surface of the cover glass 31 in association with the user's operation of inserting the cartridge 7 in the rotation axis direction of the photosensitive drum 1.

Unlike the first exemplary embodiment, the operator, such as a user or a serviceman, does not need to perform any special operation for cleaning the cover glass 31. The cover glass 31 can be cleaned by the user's normal operation of inserting and removing the process cartridge 7. Therefore, it is possible to improve usability, and to reduce the possibility that an image defect will be caused by soiling of the surface of the cover glass 31.

Third Exemplary Embodiment

Figure 8A:
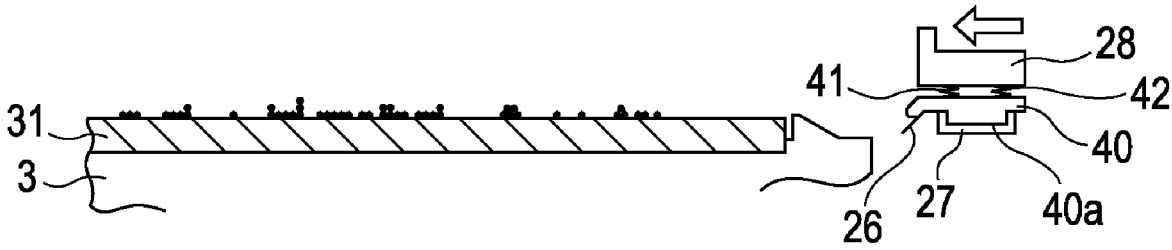
FIGS. 8A and 8B are structural view of a cleaning member according to a third exemplary embodiment of the present invention.
Figure 8B:
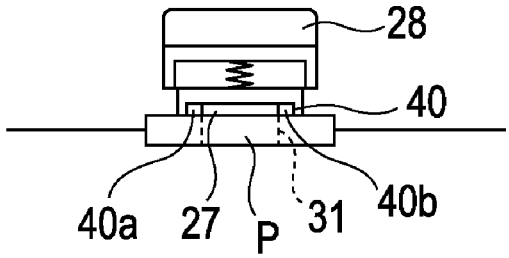

An image forming apparatus according to a third exemplary embodiment of the present invention will now be described with reference to the drawings. FIGS. 8A and 8B show the structure of a cleaning member in the third exemplary embodiment. FIG. 8A is a side view of the cleaning member and a cover glass, and FIG. 8B is a cross-sectional view of the cleaning member, as viewed in a direction opposite the forward direction. Components similar to those adopted in the first exemplary embodiment are denoted by the same reference numerals, and redundant descriptions thereof are omitted.

As shown in FIGS. 8A and 8B, the cleaning member includes a base member 28 supported by a base guide 29 fixed to the body of the image forming apparatus, and a base support 40 serving as a holding portion that holds a cleaning sheet 26 and a wiping member 27. The base support 40 has contact faces 40*a* and 40*b* that strike a cover glass 31 when the base guide 29 is pressed down and the cleaning member comes into contact with the cover glass 31. The contact faces 40*a* and 40*b* are arranged so that the cleaning sheet 26 and the wiping member 27 are disposed therebetween, and strike outer sides of a light-beam passing region P of the cover glass 31.

Figure 9A:
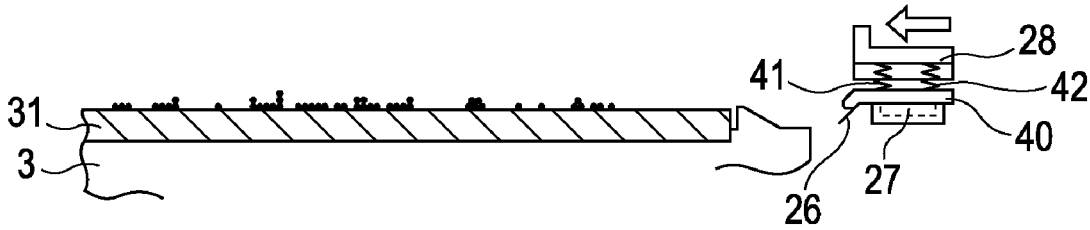
FIGS. 9A and 9B are cross-sectional views showing a cleaning process of the cleaning member in the third exemplary embodiment.
Figure 9B:
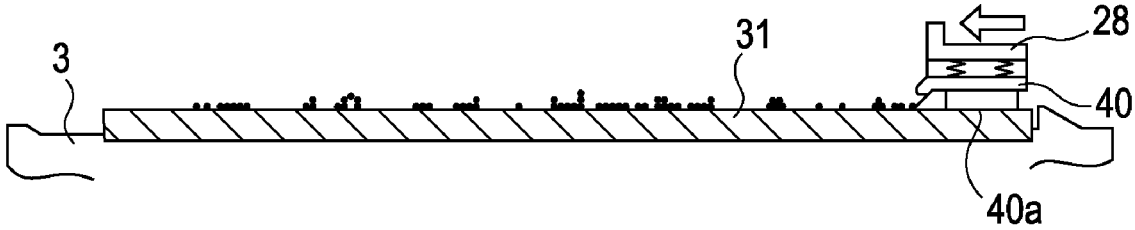

FIGS. 9A and 9B are cross-sectional views of a cleaning process of the cleaning member. When the cleaning member is placed at a home position (cleaning start position) before cleaning, as shown in FIG. 9A, the base support 40 is simply supported on the base member 28 by springs 41 and 42 serving as elastic members, but is out of contact with other components.

When the cleaning member moves forward in a cleaning state, as shown in FIG. 9B, the base member 28 is pressed down, and a leading edge of the cleaning sheet 26 and the wiping member 27 are placed at a position lower by 1 mm than the surface of the cover glass 31. That is, the displacement of the leading edge of the cleaning sheet 26 and the wiping member 27 in the contact direction is 1 mm. In this case, the contact faces 40*a* and 40*b* are in contact with the surface of the cover glass 31.

As for the height relationship between the cleaning member and the surface of the cover glass 31, the amount of pressing of the base member 28 varies in accordance with dimensional variations. Accordingly, in order to absorb the variations in the amount of pressing of the base member 28, the springs 41 and 42 are compressed after the contact faces 40*a* and 40*b* strike the surface of the cover glass 31. By this compression of the springs 41 and 42, the leading edge of the cleaning sheet 26 and the wiping member 27 are held at the position lower by 1 mm than the surface of the cover glass 31. For this reason, the pressure of the springs 41 and 42 is set so that the leading edge of the cleaning sheet 26 and the wiping member 27 are held at the position lower by 1 mm than the surface of the cover glass 31 even when the amount of pressing of the base member 28 varies.

With the above-described configuration, the height relationship of the leading edge of the cleaning sheet 26 and the wiping member 27 with the surface of the cover glass 31 can always be constant, and stable cleaning performance can be obtained.

Fourth Exemplary Embodiment

Figure 10:
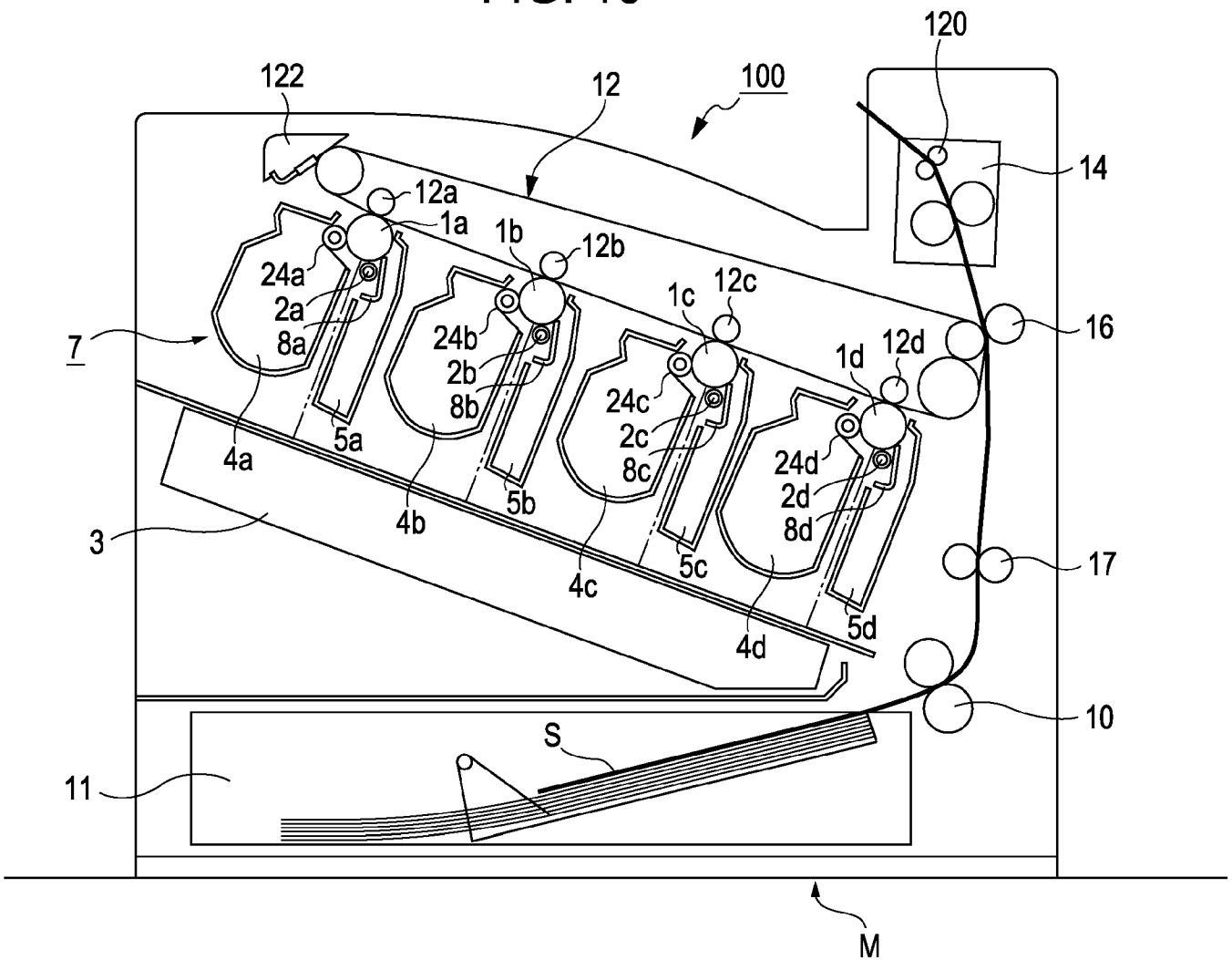
FIG. 10 is a cross-sectional view of a multicolor image forming apparatus according to a fourth exemplary embodiment of the present invention.
Figure 11:
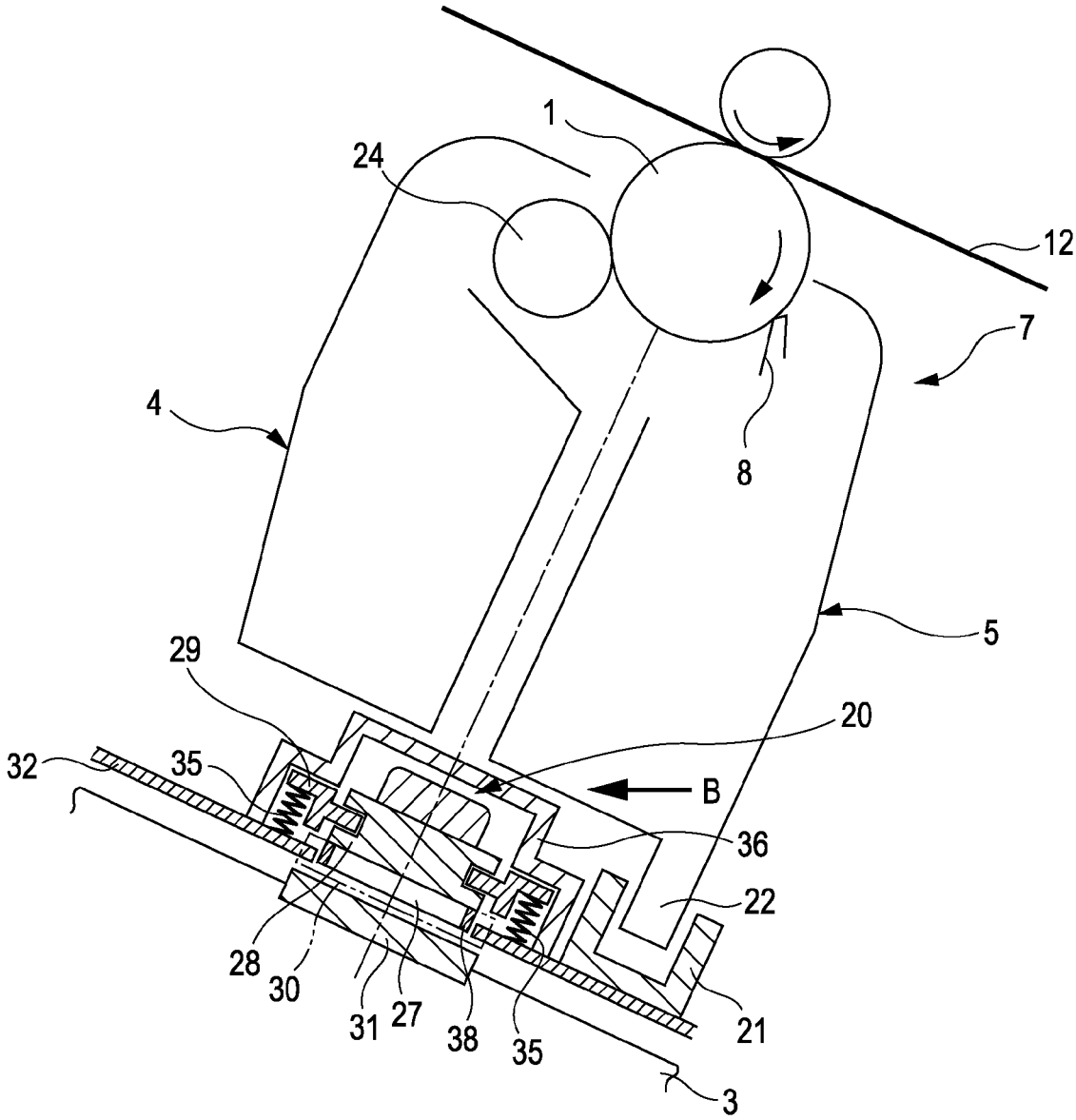
FIG. 11 is a cross-sectional view showing an optical unit, a process cartridge, and a cleaning member in the fourth exemplary embodiment.
Figure 12:
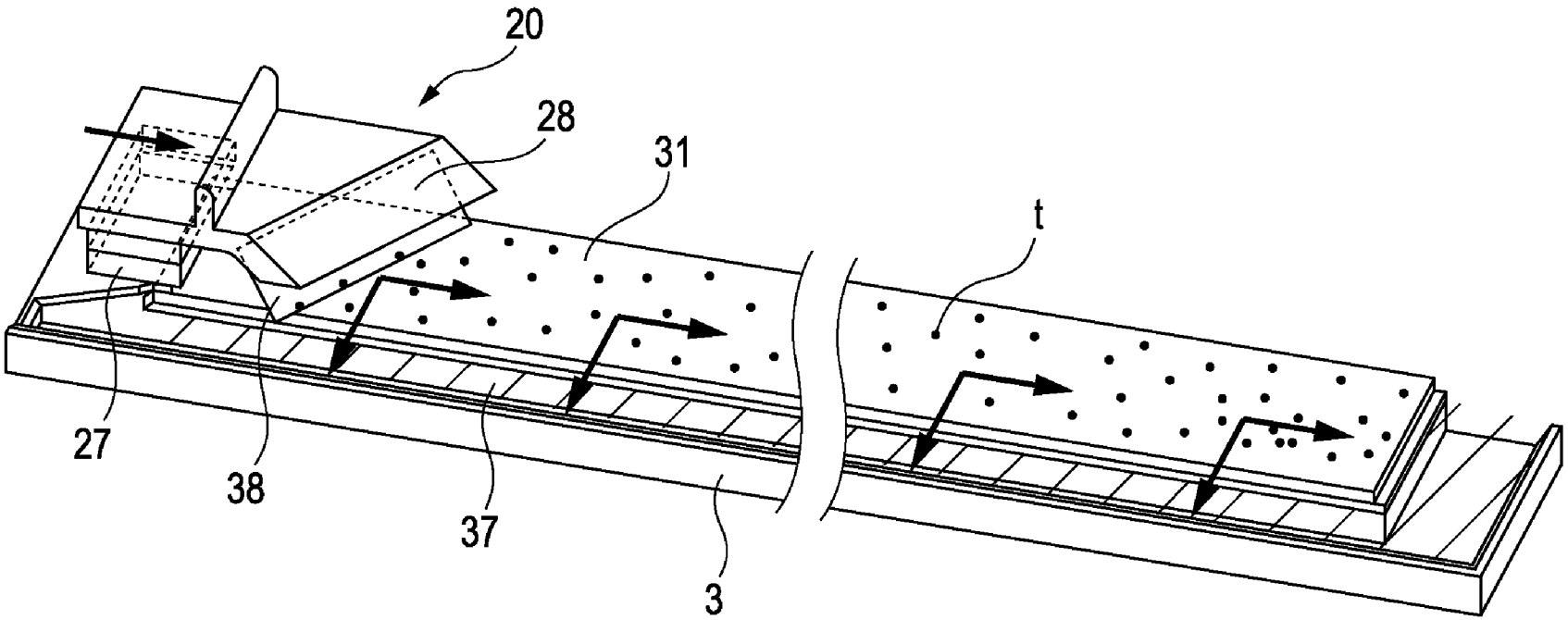
FIG. 12 is a perspective view of the cleaning member in the fourth exemplary embodiment.

An image forming apparatus according to a fourth exemplary embodiment of the present invention will now be described with reference to FIGS. 10 to 12. FIG. 10 is a longitudinal sectional view showing the overall configuration of a color laser printer 100 serving as the image forming apparatus according to the fourth exemplary embodiment. FIG. 11 is a cross-sectional view generally showing a cleaning member 20, as viewed from the principal section of the body of the printer 100. FIG. 12 is a perspective view of the section shown in FIG. 11, as viewed in the B-direction in FIG. 11. Components similar to those adopted in the first exemplary embodiment are denoted by the same reference numerals, and redundant descriptions thereof are omitted.

In the color laser printer 100 shown in FIG. 10, four photosensitive drums 1 (1*a*, 1*b*, 1*c*, and 1*d*) are arranged in a direction inclined relative to an installation surface M on which the body of the laser color printer 100 is installed. An optical unit 3 provided below the photosensitive drums 1 and an intermediate transfer belt unit 12 provided above the photosensitive drums 1 are also inclined relative to the installation surface M of the laser color printer 100 along the arrangement direction of the photosensitive drums 1. By thus contriving the arrangement of the units, the size of the laser color printer 100 is reduced.

As shown in FIGS. 11 and 12, the cleaning member 20 includes a base member 28, a cleaning sheet 38, and a wiping member 27. The base member 28 of the cleaning member 20 moves in the rotation axis direction of the photosensitive drum 1 along a base guide 29 supported by a stay member 32.

In the image forming apparatus according to the fourth exemplary embodiment, a storage portion 37 is provided instead of the storage portion 33. A cover glass 31 is a longitudinal member, and the cleaning member 20 moves in the longitudinal direction of the cover glass 31. The storage portion 37 is provided not only at one end of the cover glass 31 in the longitudinal direction (downstream side in the forward direction of the cleaning member 20 during cleaning), but also on a side of the cover glass 31 (a portion extending in the longitudinal direction). Therefore, the storage portion 37 can be large and can have a sufficient capacity.

The optical unit 3 is inclined relative to the installation surface M of the image forming apparatus. A surface of the cover glass 31 attached to the optical unit 3 is also inclined relative to the installation surface M of the image forming apparatus. The storage portion 37 is disposed on the lower side of the inclined surface of the cover glass 31. The stay member 32 and the cleaning member 20 provided in the body of the image forming apparatus are also inclined similarly.

The storage portion 37 prevents foreign substances collected in the storage portion 37 from adhering to the cover glass 31 again because of vibration of the body of the image forming apparatus and an external impact. Moreover, since the storage portion 37 is provided on the lower side of the inclined surface of the cover glass 31 attached to the optical unit 3, foreign substances can smoothly move into the storage portion 37 by utilizing the inclination of the surface of the cover glass 31.

The cleaning sheet 38 is inclined relative to the forward direction of the cleaning member 20 during cleaning so that a contact portion between the cleaning sheet 38 and the surface of the cover glass 31 points toward the storage portion 37 in order to more easily move foreign substances on the cover glass 31 into the storage portion 37. That is, the leading edge of the cleaning sheet 38 in contact with the surface of the cover glass 31 is inclined relative to a direction orthogonal to the forward direction of the cleaning member 20 from the cleaning start position to the cleaning end position. In the fourth exemplary embodiment, the cleaning sheet 38 is inclined about 60° relative to the forward direction. Therefore, when the cleaning sheet 38 moves in the forward direction, it can move foreign substances, such as toner and dust, downward along the inclined surface of the cover glass 31 and also far in the forward direction. Since even many foreign substances can be sequentially moved into the storage portion 37, passage of the foreign substances between the cleaning sheet 38 and the surface of the cover glass 31 can be minimized.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-049132 filed Feb. 28, 2007, and Japanese Patent Application No. 2008-014551, filed Jan. 25, 2008, which is hereby incorporated by reference herein in its entirety.

What is claimed is:

1. An image forming apparatus comprising:

a plurality of process cartridges, each of the plurality of process cartridges including an image bearing member configured to bear a toner image and a process unit configured to act on the image bearing member, wherein the plurality of process cartridges are insertable into and drawn out of a body of an image forming apparatus;

an optical unit provided below the plurality of image bearing members and including a plurality of transmission members configured to transmit light emitted toward the plurality of image bearing members; and a plurality of cleaning members configured to clean a surface of the plurality of transmission members, each of the plurality of cleaning members includes a sheet configured to move a foreign substance on the surface of the transmission member, and a wiping portion configured to wipe away a foreign substance on the surface of the transmission member, wherein the sheet and the wiping portion move in contact with the surface of the transmission member when the cleaning member cleans the surface of the transmission member, wherein the wiping portion moves in contact with a portion of the surface of the transmission member after the sheet moves in contact with the portion, wherein each of the plurality of process cartridges has an engaging portion that engages the cleaning member, and wherein each of the cleaning members to which the engaging portion is engaged moves in association with a movement of a corresponding process cartridge.

2. The image forming apparatus according to claim 1, wherein each of the plurality of transmission members is a longitudinal member, wherein each of the image bearing members is rotatable, wherein a longitudinal direction of the plurality of transmission members substantially coincides with a rotation axis direction of the plurality of image bearing members, and wherein each of the plurality of cleaning members moves in the longitudinal direction of the plurality of transmission members.

3. The image forming apparatus according to claim 1, wherein the sheet and the wiping portion are in contact with the surface of the transmission member when the cleaning member cleans the surface of the transmission member while moving from a cleaning start position to a cleaning end position, and wherein the sheet and the wiping portion are out of contact with the surface of the transmission member when the cleaning member returns to the cleaning start position.

4. The image forming apparatus according to claim 1, further comprising:

a plurality of storage portions configured to store the foreign substance moved from the surface of the transmission member to the outside by the sheet of the cleaning member, wherein each of the plurality of storage portions is disposed downstream of the transmission member in a direction in which the cleaning member moves from a cleaning start position to a cleaning end position.

5. The image forming apparatus according to claim 1, wherein the cleaning member includes a contact portion configured to come into contact with an area of the surface of the transmission member that does not transmit the light when an amount of displacement of the wiping portion in a direction into contact with the transmission member reaches a predetermined value while the cleaning member cleans the surface of the transmission member.

6. The image forming apparatus according to claim 5, wherein each of the plurality of cleaning members includes a holding portion configured to hold the sheet and the wiping portion, and the holding portion is supported by an elastic member.

7. The image forming apparatus according to claim 1, wherein the plurality of image bearing members are arranged in an arrangement direction inclined relative to an installation surface of the image forming apparatus.

8. The image forming apparatus according to claim 7, wherein the optical unit is inclined relative to the installation surface of the image forming apparatus along the arrangement direction of the image bearing members.

9. The image forming apparatus according to claim 7, further comprising:

a plurality of storage portions configured to store the foreign substance moved from the surface of the plurality of transmission members to the outside by the sheet of the cleaning member, wherein the surface of the plurality of transmission members is inclined relative to the installation surface of the image forming apparatus, and each of the plurality of storage portions is disposed on a lower side of the inclined surface of the transmission member.

10. The image forming apparatus according to claim 1, wherein a leading edge of the sheet in contact with the transmission member is inclined relative to a direction orthogonal to a direction in which the cleaning member moves from a cleaning start position to a cleaning end position.

11. An image forming apparatus comprising:

a process cartridge including an image bearing member configured to bear a toner image and a process unit configured to act on the image bearing member, wherein the process cartridge is insertable into and drawn out of a body of an image forming apparatus;

an optical unit provided below the image bearing member and including a transmission member configured to transmit light emitted toward the image bearing member; and a cleaning member configured to clean a surface of the transmission member, wherein the process cartridge includes a first engaging portion to engage with the cleaning member when moving in a first direction and a second engaging portion to engage with the cleaning member when moving in a second direction that is opposite to the first direction, wherein the cleaning member is in contact with the surface of the transmission member when the cleaning member cleans the surface of the transmission member while moving from a cleaning start position to a cleaning end position by engaging the first engaging portion, and wherein the cleaning member is out of contact with the surface of the transmission member when the cleaning member returns to the cleaning start position while moving from the cleaning end position to the cleaning start position by engaging the second engaging portion.

12. The image forming apparatus according to claim 11, wherein the cleaning member includes a sheet configured to move a foreign substance on the surface of the transmission member, and a wiping portion configured to wipe away a foreign substance on the surface of the transmission member.

13. The image forming apparatus according to claim 1, wherein each of the plurality of cleaning members includes a base member on which the sheet and the wiping portion are mounted, and wherein the engaging portion moves the cleaning member by engaging to the base member.

14. The image forming apparatus according to claim 1, wherein each of the cleaning members to which the engaging portion is engaged moves in association with an insertion of the corresponding process cartridge into the image forming apparatus body.

15. The image forming apparatus according to claim 11, wherein the first engaging portion presses the cleaning portion toward the transmission member when the process cartridge is moving in the first direction, and the first engaging portion does not press the cleaning portion toward the transmission member when the process cartridge is moving in the second direction.

16. The image forming apparatus according to claim 11, wherein the cleaning member engages with the first engaging portion when the process cartridge is inserted into the body of an image forming apparatus, and the cleaning member engages with the second engaging portion when the process cartridge is drawn out of the body of an image forming apparatus.

* * * * *